US007090034B2

(12) United States Patent
Rives

(10) Patent No.: US 7,090,034 B2
(45) Date of Patent: Aug. 15, 2006

(54) REAMER HAVING TOROIDAL CRUSHER BODY AND METHOD OF USE

(76) Inventor: Allen Kent Rives, 11831 Pebbleton, Houston, TX (US) 77007

( * ) Notice: Subject to any disclaimer, the term of this patent is extended or adjusted under 35 U.S.C. 154(b) by 217 days.

(21) Appl. No.: 10/468,067

(22) PCT Filed: Feb. 14, 2002

(86) PCT No.: PCT/US02/04365

§ 371 (c)(1),
(2), (4) Date: Aug. 14, 2003

(87) PCT Pub. No.: WO02/064939

PCT Pub. Date: Aug. 22, 2002

(65) Prior Publication Data

US 2004/0074672 A1 Apr. 22, 2004

(51) Int. Cl.
*E21B 10/22* (2006.01)

(52) U.S. Cl. ..... 175/53; 175/345; 175/406

(58) Field of Classification Search ..... 175/53, 175/334, 344, 345, 376, 406
See application file for complete search history.

(56) References Cited

U.S. PATENT DOCUMENTS

| | | | | |
|---|---|---|---|---|
| 2,101,007 | A | 11/1937 | Maher | 255/73 |
| 2,124,414 | A * | 7/1938 | Goldman | 175/334 |
| 3,851,719 | A * | 12/1974 | Thompson et al. | 175/406 |
| 4,117,895 | A | 10/1978 | Ward | 175/53 |
| 4,596,295 | A | 6/1986 | Bengtsson | 175/361 |
| 4,967,854 | A | 11/1990 | Barnetche-Gonzalez | 175/353 |
| 5,351,764 | A | 10/1994 | Cherrington | 175/53 |
| 5,485,888 | A | 1/1996 | England | 175/53 |
| 2004/0188141 | A1 * | 9/2004 | Slaughter et al. | 175/53 |

FOREIGN PATENT DOCUMENTS

WO WO 03/080985 * 10/2003

* cited by examiner

*Primary Examiner*—William Neuder
(74) *Attorney, Agent, or Firm*—David B. Dickinson; Lundeen & Dickinson, LLP

(57) ABSTRACT

The present invention provides a reamer (100) having at least one journal body (110) and at least one toroidal cutter body (116). The toroidal cutter body (116) has a maximum diameter (MD), an outer perimeter (OP) and a plurality of cutting elements (112, 145, 149) on the cutting surface (118). The toroidal cutter body is rotatably attached to the journal (110). When in the installed position, the axis of rotation (RA) of the at least one toroidal cutter body (116) intersects the longitudinal axis of the drill string at an acute angle.

7 Claims, 11 Drawing Sheets

REAMER HAVING TOROIDAL CRUSHER BODY AND METHOD OF USE

BACKGROUND OF THE INVENTION

1. Field of Invention

The present invention relates to a down hole tool for enlarging a drill bore; and more specifically it relates to a reamer that enlarges a pilot hole.

2. State of the Art

It has long been known by those involved in drilling subterranean bore holes for oil and gas exploration, mineral recovery or in utility construction projects, to employ reamers to enlarge bore holes after a smaller pilot hole has been drilled. Pilot holes can be drilled economically and more precisely. Pilot holes can also be drilled with down hole motors that can be guided to the desired location from the point of ingress of the drill string.

Prior reamers have heretofore been manufactured in several distinct styles. One type of reamer provides extensible arms and cutters that are used to enlarge the hole to a larger diameter by rolling and crushing the face and sides of the borehole with hardened buttons or dressed teeth. It is well known in the drilling industry that these buttons or dressed teeth can be fabricated from materials such as tungsten carbide or polycrystalline diamond compact (PDC) or the like. The second type of reamer or hole opener consisted of a tubular body with a plurality of arms supporting journals and cutter bodies to extend to and crush the well bore. These arms, whether extensible or fixed, and the smaller cutter cones carried on those arms, are subject to failure in the hole as a result of their limited bearing surfaces and the smaller buttons, which wear out prematurely. As the number of arms increases, the size of the bearings that can be used to provide rotational movement of the cutter around each support arm diminishes, limiting the life thereof. Further, because the extensible arms and cutter bodies were held next to the body while going into the borehole, material was removed from the tubular body further weakening the integrity of the entire tool. Other types of reamers or hole openers have been fashioned with three or more fixed cones on journals mounted on integral posts on a tubular body. These hole openers or reamers were similarly limited in the size of the cones and bearings supported. The small cutter buttons and bearing surfaces cause short service lives and can lead to premature failure of the tool. When failure occurred down hole for either type of reamer (extensible arm or fixed arm), substantial time and effort was required to fish the tool from the bore or to drill around the tool to complete the drilling program.

As noted above, prior art reamers generally provide a plurality of cutter posts and journals onto each of which a cone having tungsten carbide buttons is mounted. Because at least three cones are used on either type of reamer, the cones were of limited size and typically provide small surfaces to contact the borehole face to be reamed. Since smaller hardened buttons (or less hard facing—which alternatively can be used to dress the surface of such cutters) are used to cut the well bore surface, the service life of the reamers is shorter than it would be for tool providing a larger overall bearing surface disposed with larger hardened button cutters. The life of these tools requires that the cutters and journals be redressed to continue their useful life. This redressing historically required the tool to be taken out of service and returned to the shop for repair and reconstruction.

Further, the normal operating problems of conventional hole openers is xacerbated when drilling horizontal or near horizontal applications. In such situations, the load and wear characteristics coming to bear on the support arms can cause early and catastrophic failure of the arm structure and often results in loss of cutters in the borehole itself. Additionally, in horizontal or near horizontal applications, the support arms of conventional openers create additional torque on the tubular string that carries the reamer. The additional torque slows drilling progress and makes the cost per foot of opened hole rise.

These problems can cause failure of both the support arms and loss of cutters in the hole requiring expensive retrieval operations and delay the completion of the operation.

A new type of reamer has long been sought which provides a longer service life because it provides large bearing surfaces and large tungsten carbide buttons or hard facing, which could be used in normal drilling operations to open previously drilled pilot holes. Prior art reamers could not be used under conditions which resulted in substantial longitudinal loading. In utility construction drilling projects, such as river crossings where bore holes are drilled under rivers to permit the installation of utility pipelines, it is often useful to drill from one side of the river to the other with a pilot drill, then ream the hole going from the pilot hole egress side to the ingress side. Utility construction typically therefore requires a reamer that is pulled with substantial force back through the pilot hole. In most drilling projects, substantial or large amounts of longitudinal loading are generally avoided, thereby preventing excessive torque from being introduced into the drill string.

SUMMARY OF THE INVENTION

In its broadest aspect, the present invention provides a reamer having at least one journal body, means for attaching the at least one journal body to the drill string, at least one toroidal cutter body, each having a maximum diameter, an outer perimeter at the maximum diameter, a cutting surface and a plurality of cutting elements on the cutting surface, wherein the at least one toroidal cutter body is rotatably attached to the at least one journal body, and when in an installed position, the axis of rotation of each of the at least one toroidal cutter body intersects the longitudinal axis of the drill string at an acute angle and the outer perimeter encircles the longitudinal axis.

In one embodiment of the present invention, the reamer has a journal body and at least one toroidal cutter body rotatably mounted on the journal body. The cutter body has an axis of rotation at an acute angle to the longitudinal axis of the drill string to which it connected. The outer perimeter of the cutter body at its maximum diameter encircles the longitudinal axis of the drill string. The cutter body has a cutting surface. The cutter body is free to rotate about such axis as a portion of the cutting surface of the cutter body, preferably not more than one-half of the cutting surface, is moved into engagement with the face of the well bore adjacent the pilot hole. As the drill string rotates, the reamer engages the well bore at the borehole face with a cutting or impact element on a portion of the rotatable cutter body, while holding the adjacent cutting or impact elements away from the bore face. The reamer of the present invention provides a large surface upon which large cutting elements can be located or mounted, thus providing a reamer having a long service life. Relatively speaking, the cutter body is larger than prior art cones used for a similar sized hole and thus provides the ability to provide the reamer with large well-lubricated bearings and bearing races, which also extend the service life of the reamer. This is an important feature when using the reamer with a drill bit or drill motor and bit to perform a ream while drilling to minimize the amount of time required to ream the bore hole.

In one embodiment of a reamer according to the present invention, the reamer has a first coupling adapter or sub providing means, usually a threaded surface, to connect to a journal body; a second coupling adapter or sub providing a second means, such as the threaded pin, to connect to the journal body. The dual journal body provides threaded bores on each side to connect to the first and second coupling adapters. The journal body and the races formed on its outer periphery is skewed from the central longitudinal axis of the adapters and the threaded bores on either side of the journal. At least two toroidal cutter bodies rotatably supported on each side of said journal body, provide an axis of rotation slightly deviating from the central longitudinal axis of the dual journal body and the two connected coupling adapters, which coincides with the longitudinal axis of the drill string.

Accordingly, several of the objects and advantages of the present invention can be readily appreciated from the disclosure of the present invention.

Since the present invention has eliminated the support arms and provides significantly larger bearings and bearing surfaces supporting the cutters, the operational life is greatly extended. Conventional hole openers, because of their mass, require special handling to install and replace at the job site. Several embodiments of the present invention are compact and significantly lighter than the conventional devices permitting easy installation, removal and replacement.

Another feature of the present invention is that only selected cutters engage the formation to be cut. Conventional cutters were supported by support arms that supported the distal end of the cutter body. With the present invention, the cutter is supported by the journal spindle substantially coaxial with the longitudinal axis of the drill string. The profile of the cutter within the annulus is more compact because there is no dragging of the support arm past the formation opened by the cutter. This feature also reduces the drag and torque on the body itself and on the whole drill string thereby reducing mechanical wear on the drilling assembly from this operation. The tubular member carrying the hole opener experiences less torque than prior conventional hole openers and requires less mechanical energy to open the hole to the desired inner diameter.

A still further benefit of the present invention is that it permits a smaller pilot hole to be used to provide the initial pathway for the driller. Since the overall outer diameter profile of the reamer, approximating the diameter of the drill string for the pilot hole, is smaller than conventional openers, a smaller and therefore more economical pilot hole can be drilled. Drilling of a smaller pilot hole can be accomplished more quickly than drilling a larger diameter pilot hole and can be accomplished by a smaller drilling rig that is also more economical.

Additionally, in one embodiment of the present invention, the cutter body is symmetric in construction, front to back (that is, relative to its maximum diameter. Accordingly, it can be reversed as cutter elements wear down and the former back of the cutter body would then be used as the primary cutter surface facing the direction of travel of the reamer.

Significantly, the present invention provides a reamer which can be either pushed or pulled through the pilot hole with greater longitudinal loading than previously used with such tools without the danger of introducing such excessive torque, while still providing a long service life because of its large bearing surfaces and cutter elements, for example, cutter buttons. The combination of these benefits thereby satisfies a long felt but unanswered need of the drilling industry in a new and unobvious way.

The reamer cutter body of the present invention is wholly consumable and can be scrapped at the bore hole site when totally worn. There is no need to return the body to the manufacturer. The cutter body can be replaced and the reamer reused.

DETAILED DESCRIPTION OF THE PREFERRED EMBODIMENT

Figure 1:
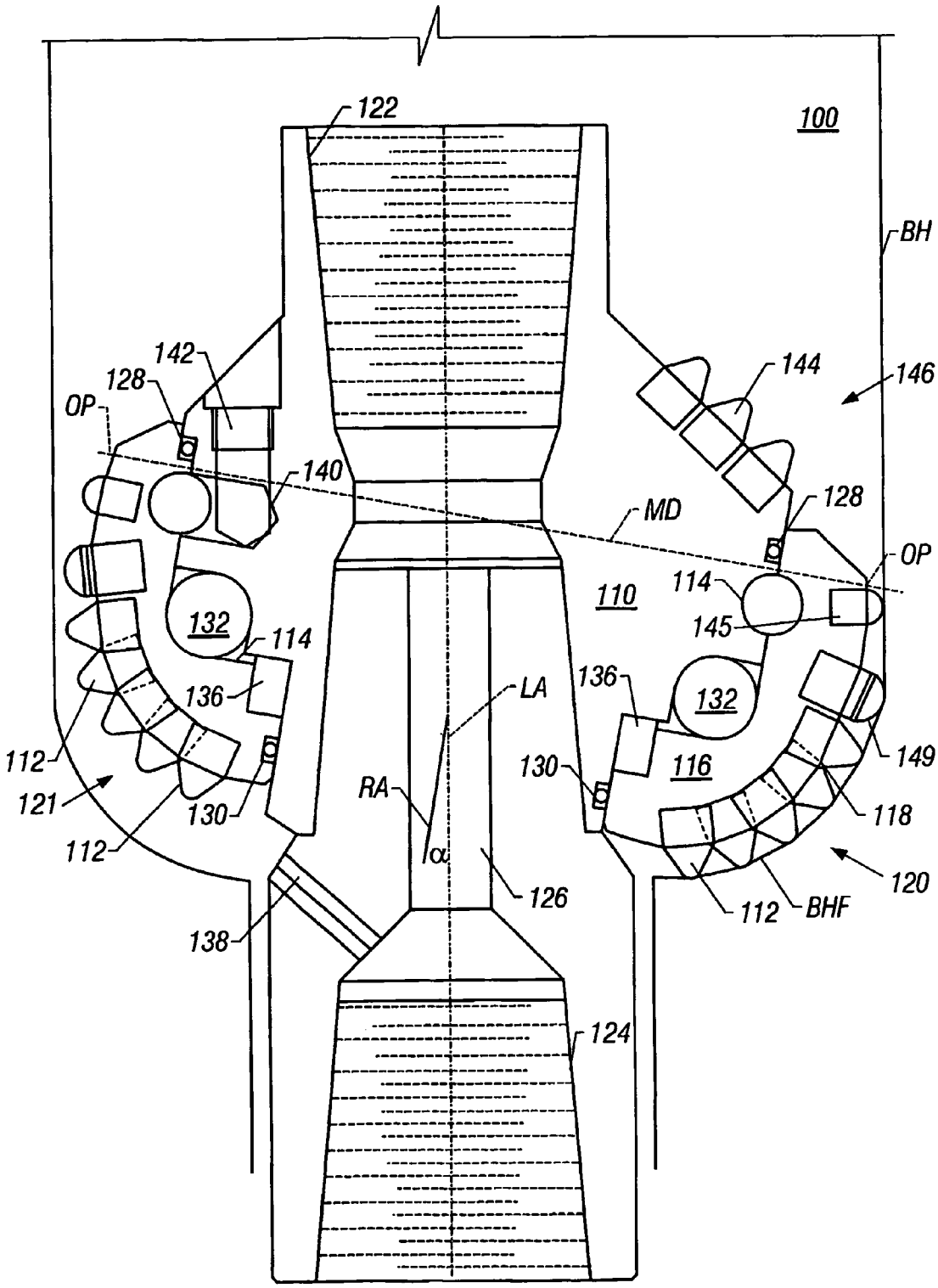
FIG. 1 is a cross-sectional view of an embodiment of a reamer according to the present invention adjacent a bore hole face.

Referring now to the drawings in which like numerals denote similar elements, and more particularly to FIG. 1, there is shown by way of illustration, but not of limitation, a reamer 100 providing a journal 110 having an axis of rotation RA skewed at an acute angle $\alpha$ from the longitudinal axis LA of the drill string to which the reamer 100 is attached. As drilling proceeds, the reamer 100 is free to rotate slowly engaging the face BHF of the hole BH to be reamed with adjacent radial rows of irregularly spaced hardened buttons or impact elements that crush the rock against which they come in contact.

The cutting elements, buttons 112, 145, 146 and 149 in this embodiment and such elements in the embodiments shown in FIGS. 2–11, are made from tungsten carbide. It may appreciated that such hardened buttons can also be fabricated from polycrystalline diamond compact (PDC), thermally stable polycrystalline diamond cutters (TSP), natural diamond, or steel teeth with hard facing, all in a manner well known to those skilled in the art. Likewise, the shape of the cutter buttons can be of a variety of designs or shapes in accordance with the desired use for a given type of formation to be reamed. For example, the buttons could be ovoid or ogive shaped, conical or 90° chisel shaped, or scooped or crested cutter buttons, in a manner well known to those in the drilling industry, without departing from the spirit or intent of this invention.

In the various embodiments disclosed herein, because the reamer body or journal provides a much larger surface than the roller cones found on most prior art reamers, the buttons can be fabricated larger than would normally be used in the tool sized for use in this application. Consequently, the wear life of the reamer is extended because these larger buttons or impact elements have substantially longer service lives. Likewise, the reamer of the present invention allows the toroidal cutter body to be mounted on a journal that provides larger bearing surfaces or races for thrust and roller bearings formed on its outer surface that likewise assure a longer service life for the reamer.

The reamer 100 shown in FIG. 1 could be used wherever a pilot hole had previously been drilled to enlarge the hole or bore to its desired gauge. As may be readily appreciated, the reamer has a toroidal cutter body 116 around the longitudinal axis LA of the drill string, but is skewed to have an axis of rotation RA and provide a rolling movement of the cutter body 116 against the face BHF of the surface of the well bore being opened. Viewed from the side, cutter body 116 will rotate slowly (at a rate slower than the drill string) clockwise around the axis of rotation of the drill string, that is, the longitudinal axis LA. The drill hole bore BH is engaged by the reamer buttons 112 as the cutter body 116 rotates about its axis of rotation RA and around the longitudinal axis LA of the drill string, wherein the axis of rotation RA intersects the longitudinal axis LA at an acute angle $\alpha$. The outer perimeter OP at the maximum diameter of the cutter body 116 encircles the longitudinal axis LA. In the snap-shot in time shown in FIG. 1, the arrangement of the buttons on the cutting surface 118 of the body 116 assures that only a portion 120 of the buttons 112 are fully engaged as adjacent buttons are moved closer to full engagement. All of the buttons 112 on the opposing portion 121 are off the surface BHF of the borehole thereby preventing dragging or galling of the cutter body 116 in the hole as this crushing movement occurs.

The reamer 100 provides threaded surfaces on each end of its longitudinal axis to connect with the drill string 10 (not shown here) at 122 and with the lower bottom hole assembly BHA (not shown here) at 124. Reamer 100 can be placed below a centralizer and above a drill bit or drilling motor (not shown) in a manner well known to those engaged in the drilling industry.

As shown in FIG. 1, reamer 100 has a cutter body 116 that is fabricated in a toroidal shape having an interior surface providing a bearing race 114. Alternatively, the interior surface of the toroidal cutter body 116 can be machined conically (not shown) to permit a tapered roller bearing to be used to facilitate rotation of the cutter body 116.

The exterior surface of the toroidal cutter body 116 is machined to accept a multiplicity of tungsten carbide buttons, such as those shown at 112, 145 and 149 that are inserted in each of the spaced holes. The spacing of the holes on the cutting surface 118 is made to provide a maximum coverage of cutting surface 118 of the cutter body 116 with buttons 112. Buttons 112 are chosen to maximize the size of the buttons. The choice of buttons and their spacing prevents any specific part of the body from receiving excessive wear. The size of buttons which can be used in the present invention are much larger than those which can be used on individual cones adapted for use on a standard reamer which can be used in the similar sized well bore.

Figure 6:
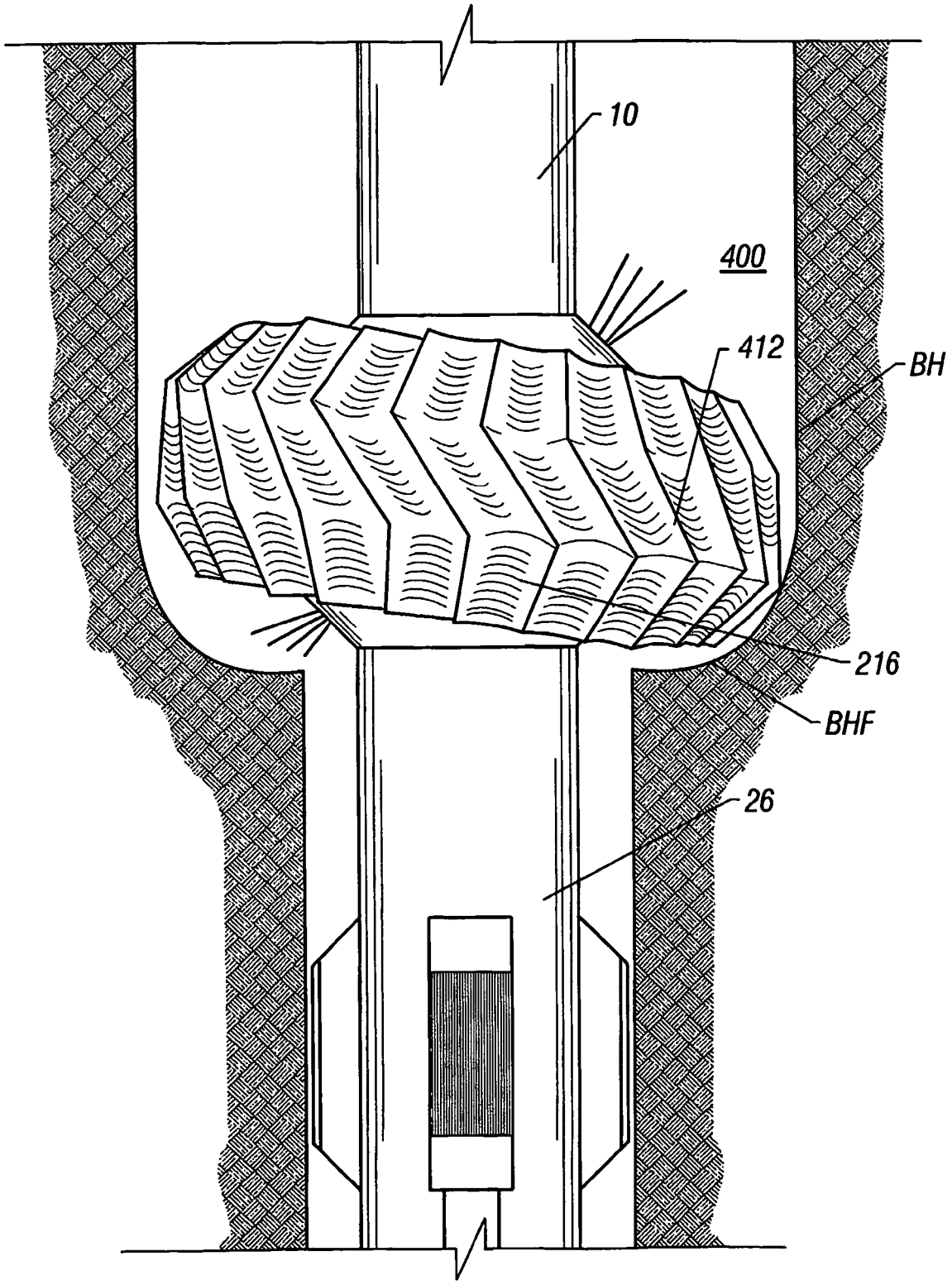
FIG. 6 is a perspective view of another embodiment of a reamer according to the present invention in a pilot hole with a centralizer (mill teeth in a zig-zag pattern).

It is well known to those skilled in the art of manufacture of drilling and reaming tools that mill tooth cutter bodies can also be used to accomplish opening in certain types of formations. A mill tooth surface (not shown) can also be fabricated on the cutter body. The mill tooth cutter surface would be interrupted to allow passage of fluid and cuttings around the teeth, but in all other pertinent aspects would be like existing mill tooth cutter bodies. One example of a mill tooth cutter surface is shown in FIG. 6 having a zig-zag pattern.

Body 110 is fabricated from steel tubular member that provides the threaded surfaces for connection to the tubular members described above in the drill string and in the bottom hole assembly. Body 110 also provides a longitudinal passage 126 to permit fluid communication through the body 110. Body 110 is machined to provide seals in seal grooves 128 and 130 to protect the bearings 132, 134 and 136 and races 114, from hydraulic contamination from the drilling fluid. The exterior surface of journal body 110 is obliquely skewed at an angle of about 10° from the longitudinal axis LA of the body 110 to rotatably support the cutter body 116.

Body 110 also provides at least one port to permit the jetting of drilling fluid against around the reamer to carry cuttings away from the reamer body and to lubricate and cool the cutters. Port 138 points away from the face BHF of the well bore being reamed. Retainer bearings 134 are inserted and maintained in the race formed between the exterior surface of the body 110 and the interior surface of the cutter body 116 by a passage 140 in the body 110. A head cap screw 142 is inserted in the passage 140 to seal the retainer bearings 134 in the race.

Moving the cutter body 116 over the seals 130 and roller bearings 136 assembles the reamer 100. Ball bearings 134 are then inserted and the plug (head cap screw 142) is inserted into place.

It may also be appreciated that the body 110 can also provide the support for different sized cutter bodies. The same size tubular body 110 can also be used to support an 8½ inch cutter body (not shown).

In operation, the cutter body 116 is free to revolve around its axis of rotation RA at an acute angle $\alpha$ to the longitudinal axis LA of the drill string and body 110. The outer perimeter OP at the maximum diameter MD of the cutter body 116 encircles the longitudinal axis LA. Another way of expressing this is that the longitudinal axis LA intersects th plane defined by the outer perimeter OP. This skewed angle $\alpha$ permits the hardened buttons to crush the face of the well bore being enlarged and roll slowly as the cutter body 116 moves around the longitudinal axis LA to engage adjacent surfaces. The cooperating individual buttons 112 on the contact portion 120 of the cutting surface 118 of the cutter body 116 engage the borehole BH. In operation, the radially and irregularly positioned buttons or cutter elements selectively crush and stabilize the reamer as adjacent cutter elements are moved onto crushing engagement with the surface of the bore.

The reamer 100 also permits the hardened buttons, such as representative button 144, on the posterior side 146 of the body 110 of the reamer 100 to continue cutting as reamer 100 is moved out of the hole BH. This feature is useful in unconsolidated subterranean structures that collapse on the drill string as the reamer passes. This feature also provides well defined and smooth enlarged bore holes, the desired end result of the reaming process.

Figure 2:
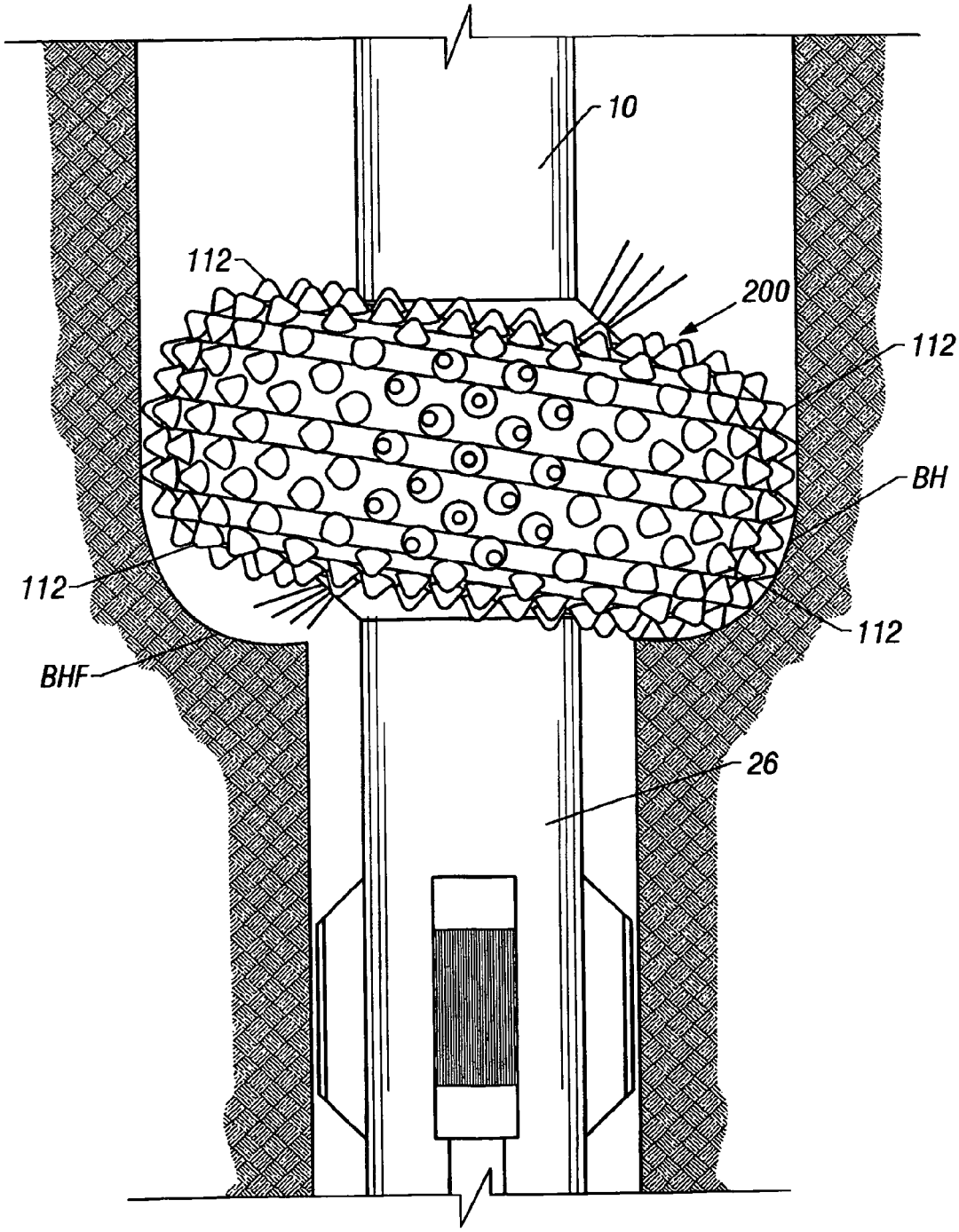
FIG. 2 is a perspective view of another embodiment of a reamer according to the present invention in a pilot hole with a centralizer (cutter buttons).
Figure 4:
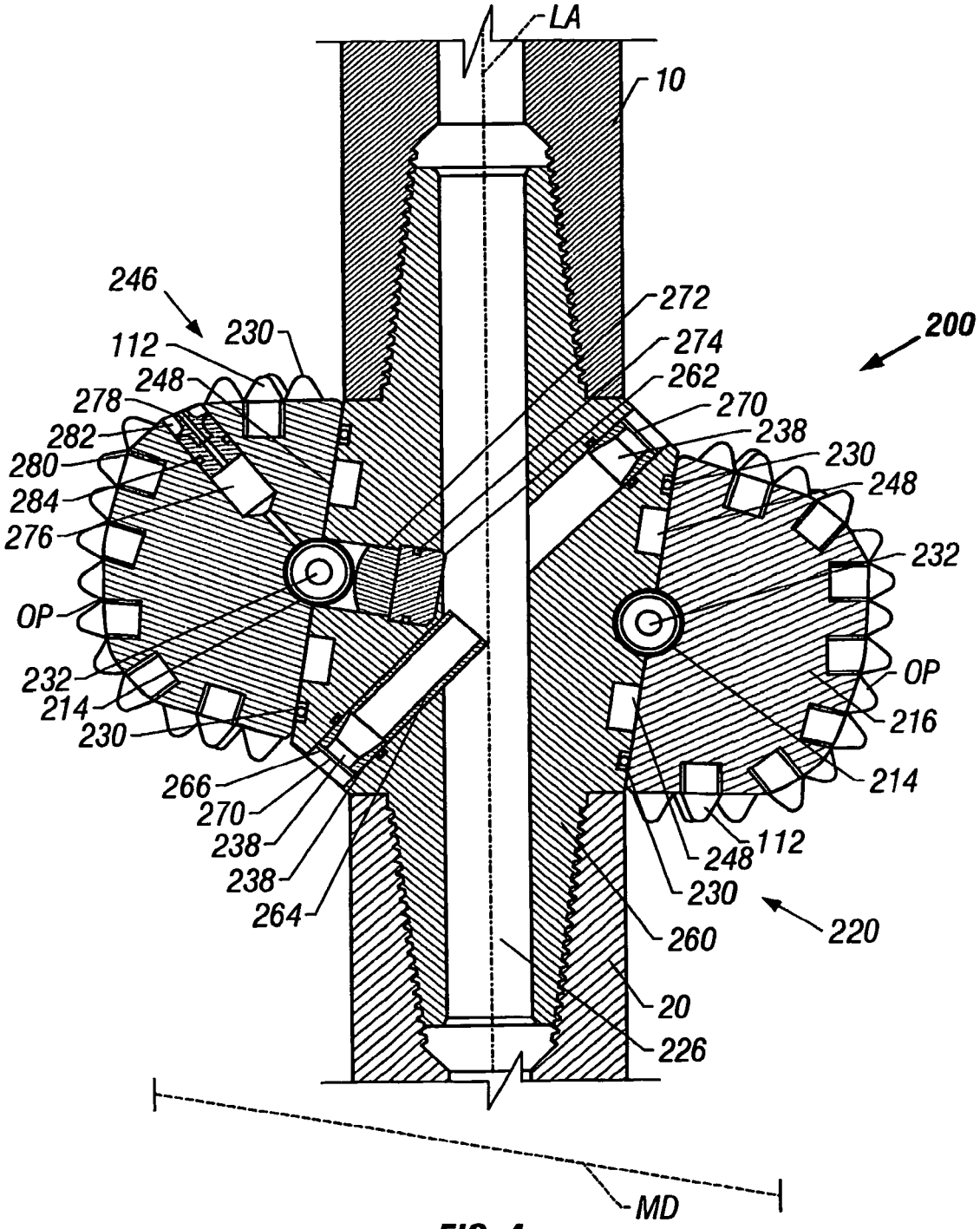
FIG. 4 is a cross-sectional view of the reamer body according to FIG. 2 connected in a drill string.
Figure 5:
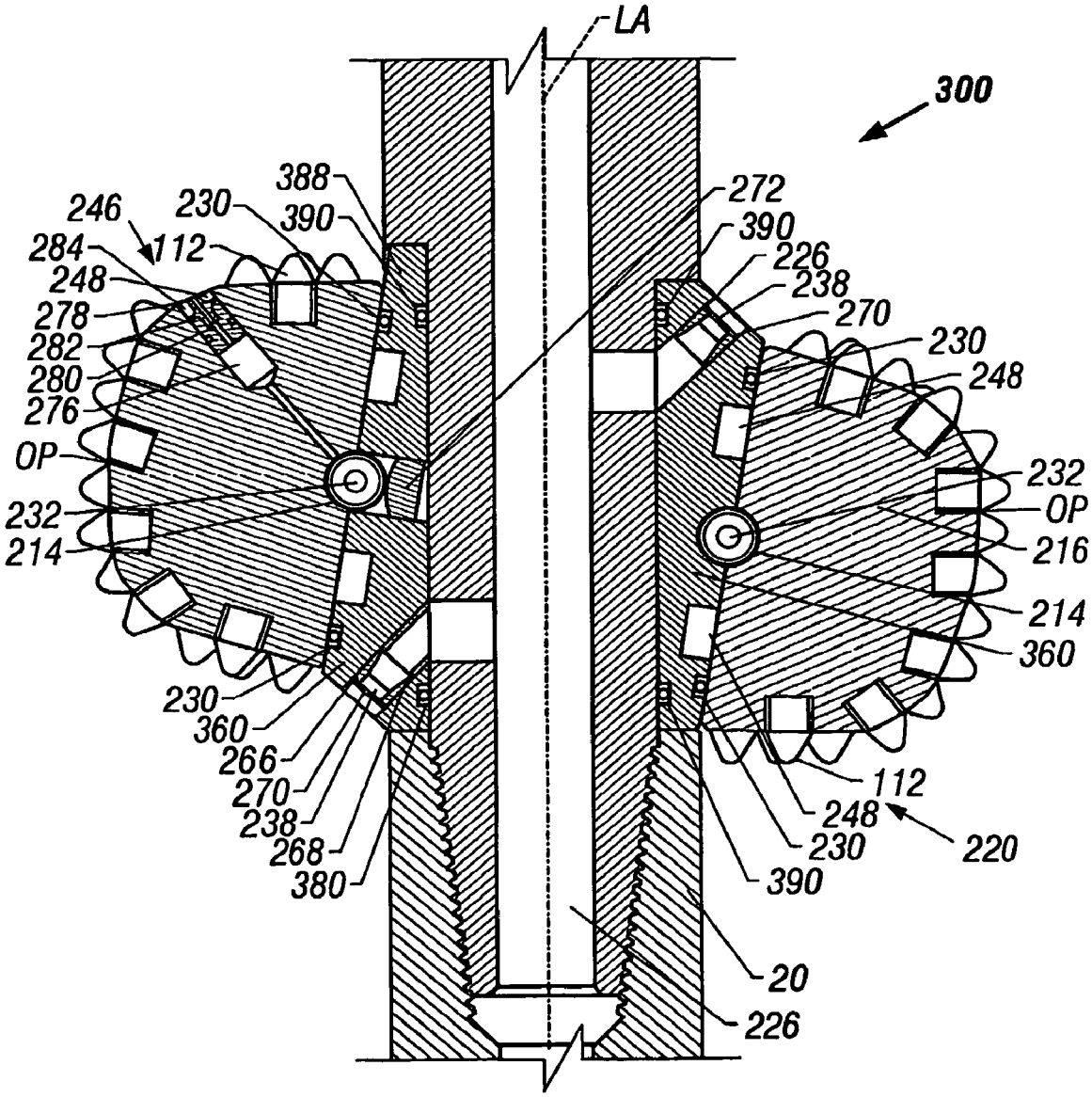
FIG. 5 is a cross-sectional view of another embodiment of a reamer according to the present invention providing a removable journal body on a tubular body.

FIGS. 2, 4 and 5 show the reamer 200 providing an axis of rotation RA skewed at an acute angle α from the longitudinal axis LA of the drill string to which the reamer is attached. As drilling proceeds, the reamer is free to rotate slowly engaging the face of the hole to be reamed with a row of hardened buttons that crush the rock against which they come in contact.

The reamer 200 shown in FIG. 2 could be used wherever a pilot hole had previously been drilled to enlarge the hole or bore to its desired gauge. Typically, the reamer 200 is connected to a drill string 10 above it. As shown in FIG. 2, a centralizer 26 can be attached or connected adjacent the reamer 200 to centralize the reamer 200 in the hole BH.

Figure 3:
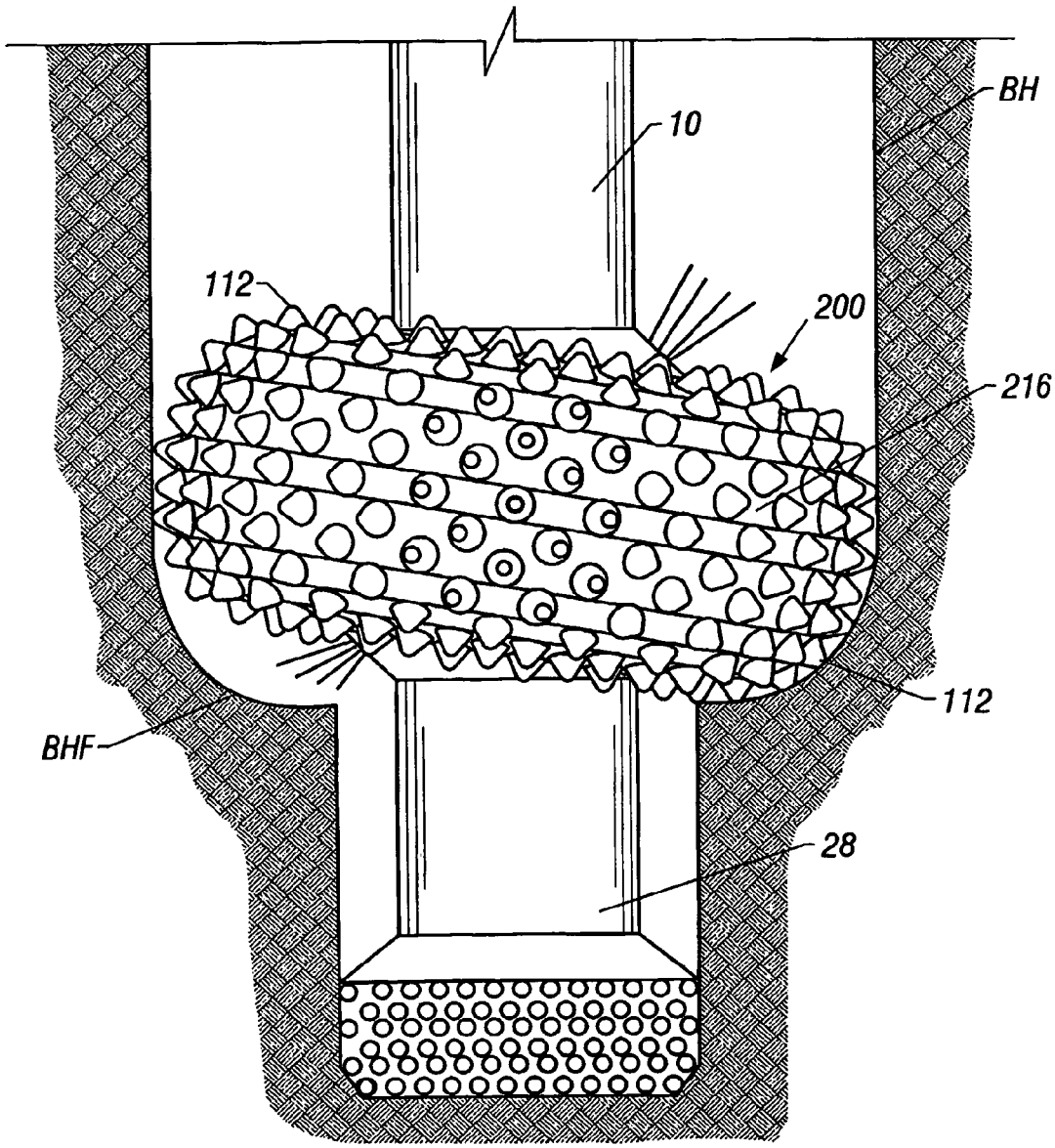
FIG. 3 is a schematic representation of the reamer body according to FIG. 2 in a representative bottom hole assembly.

FIG. 3 shows the reamer 200 in a perspective view mounted adjacent a stylized drill bit assembly 28 which could be either a diamond bit system or a standard cone drill bit, either of which are well known to persons having ordinary skill in the art. As may be readily appreciated, the reamer has a toroidal cutter body 216 around the longitudinal axis LA of the drill string, but the axis of rotation RA thereof is skewed at an acute angle α thereto (see FIGS. 3 and 4) to provide a rolling movement of the cutter body 216 against the face BHF of the surface of the well bore being opened. Viewed from the side in FIGS. 4 and 5, reamer 200 will rotate slowly (at a rate slower than the drill string 10) clockwise about its axis of rotation RA around the longitudinal axis LA of the drill string 10. As stated earlier, another way of expressing this relationship is that the longitudinal axis LA intersects the plane defined by the outer perimeter OP of the toroidal cutter body 216 at its maximum diameter. This plane is also intersected by the axis of rotation RA at the center thereof. In this embodiment, the longitudinal axis LA also intersects this plane at the center thereof.

FIG. 4 is a cross sectional view of the reamer 200. The face BHF of drill hole bore BH is engaged by the cutter body 216 buttons 112 on opposite sides of the distal edge of the cutter body 216. The reamer 30 provides threaded surfaces on each end of its longitudinal axis to connect with the drill string 10 and with the lower bottom hole assembly 20, for example, a centralizer 26 (FIG. 2) or a stylized drill bit assembly 28 (FIG. 3). Reamer 200 can be placed below a centralizer and above a drill bit (not shown) or drilling motor (not shown) in a manner well known to those engaged in the drilling industry.

As shown in FIG. 4, reamer 200 has a cutter body 216 that is fabricated in a toroidal shape that is symmetrical relative to its maximum diameter (that is, the top and bottom halves are symmetrical) having an interior surface providing a bearing race 214. Although the interior surface of FIG. 4 discloses a right circular cylinder with a bearing race 214 approximately midway on said face, other bearing types can warrant fabrication of the interior surface having different bearing races or geometric configurations. For example, a plurality of ball bearing races (not shown) can be formed on the interior surface without departing from the spirit and purpose of the invention. Likewise, the interior surface of the toroidal cutter body 216 can be machined conically (not shown) to permit a tapered roller bearing to be used to facilitate rotation of the cutter body 216.

The exterior surface of the toroidal cutter body 216 is machined to accept a multiplicity of tungsten carbide buttons, such as those shown at 112, that are inserted in each of the spaced holes. The spacing of the holes on the exterior surface is made to provide a maximum coverage on the entire exterior surface of the cutter body 216. Buttons 112 are chosen to maximize the size of the buttons. The choice of buttons 112 and their spacing prevents any specific part of the body 216 from receiving excessive wear. The size of buttons which can be used in the present invention are much larger than those which can be used on individual cones adapted for use on a standard reamer which can be used in the similar sized well bore.

It is well known to those skilled in the art of manufacture of drilling and reaming tools that mill tooth cutter bodies can also be used to accomplish opening in certain types of formations. A mill tooth surface (not shown) can also be fabricated on the cutter body. The mill tooth cutter surface would be interrupted to allow passage of fluid and cuttings around the teeth, but in all other pertinent aspects would be like existing mill tooth cutter bodies. FIG. 6 depicts a reamer 400 like reamer 200 shown in FIG. 2 with the exception that the cutter body 216 has mill teeth 412 in a zig-zag pattern instead of buttons 112.

Body 260 is fabricated from steel tubular member that provides the threaded surfaces for connection to the tubular members described above in the drill string 10 and in the bottom hole assembly 20. Body 260 also provides a longitudinal passage 226 to permit fluid communication through the body 260. Body 260 is machined to provide seals in seal grooves 230 and roller bearings and races 248, around the exterior of the portion of the body 260. The exterior surface of body 260 is obliquely skewed at an angle of about 10° from the longitudinal axis LA of the body 260 and of the drill string 10 it will be attached to rotatably support the cutter body 216. This provides the acute angle α at the intersection of the axis of rotation RA and the longitudinal axis LA.

Body 260 also provides at least one port to permit the jetting of drilling fluid against around the reamer to carry cuttings away from the reamer body and to lubricate and cool the cutters. On FIG. 4, ports 238 point either toward or away from the face of the well bore being reamed. Ports 238 also provide a means of securing the retainer plug 262 in the body 260 by the securing engagement of sleeve 264 in port 266. The jetting ports 266 are sealed in the body 260 by O-ring 268 and retained in the body 260 by snap ring 270. The opposing jetting port 238 is likewise fitted with snap ring and O-rings to secure the jetting port in the passage.

Moving the cutter body 216 over the seals 230 and roller bearings 248 assembles the reamer 200. Ball bearings 232 are then inserted and the grease plug 272 is inserted, then locked, into place by a pressure plug 262 which fits against an interior shoulder to retain, but not compress, the grease plug 272 against the ball bearing 232 in race 214. The pressure plug 262 that seals the bearing race by O-rings 274 from contamination by drilling fluid from the interior of the reamer body 260 is retained in place by locking sleeve 264. Plug 262 seals a grease reservoir for lubricating the ball bearings 232 as they roll around the body. Grease reservoir 276 is machined into the cutter body 216 and filled through nipple 278 which is threadably engaged in floating seal 280, which seats in a recess 282 machined into the surface of the cutter body 216 which is sealed to the drilling fluid with dynamic or floating seals 280 and O-ring 284, after assembly to provide grease to the bearing race during use on demand.

It may also be appreciated that the body 260 can also provide the support for different sized cutter bodies. FIG. 4 discloses the invention with a 12-inch cutter body installed. The same size tubular body 260 as used in FIG. 4 can also be used to support an 8½ inch cutter body (not shown).

FIG. 5 shows an alternative embodiment of the invention as reamer 300 that is like reamer 200, but has a removable journal body 360 mounted on the tubular member 310 supporting the cutter body 216.

In operation, cutter body 216 of the reamer 300 is free to revolve about its axis of rotation RA at an acute angle α to the longitudinal axis LA of the drill string. The outer perimeter OP at the maximum diameter of the MD of the cutter body 216 encircles the longitudinal axis LA. Another way of expressing this is that the longitudinal axis LA intersects the plane defined by the outer perimeter OP, in this embodiment at its center. The axis of rotation RA also intersects this plane at its center, which is also the point at which the rotational axis RA and longitudinal axis LA intersect at the acute angle α. This skewed angle permits the hardened buttons to crush the face of the well bore being enlarged and roll slowly as the longitudinal axis moves to engage adjacent surfaces. The buttons 112 on the distal edge or outer perimeter OP of the reamer 200 and 300 in FIGS. 4 and 5 engage the borehole BH to provide a stable and centralizing support platform for the cutter buttons 112 that are on the portion 220 of the cutter body 216 crushing the borehole face BHF.

The reamer 200 and 300 also permit the hardened buttons 112 on the posterior side 246 of the reamer to continue cutting as reamer 200 and 300 are moved out of the hole. This feature is useful in unconsolidated subterranean structures that collapse on the drill string as the reamer passes. This feature also provides well defined and smooth enlarged bore holes, the desired end result of the reaming process.

The operation of the reamer 300 in FIG. 5 is identical to that of reamer 200 shown in FIG. 4. FIG. 5 shows the removable journal 360 mounted on tubular body 310 with seals in seal grooves 230 on the exterior surface and seals with seal groove 390 on the interior surface of the removable journal 360. This body 360 is prevented from rotation on the tubular member 310 by a dog 388 formed to fit in a recess or notch on the exterior surface of the tubular body 310. Other means to prevent rotation could be used, such as splines, key and key seat, hexagonal shaping or the like, without departing from the spirit of the invention.

Figure 7:
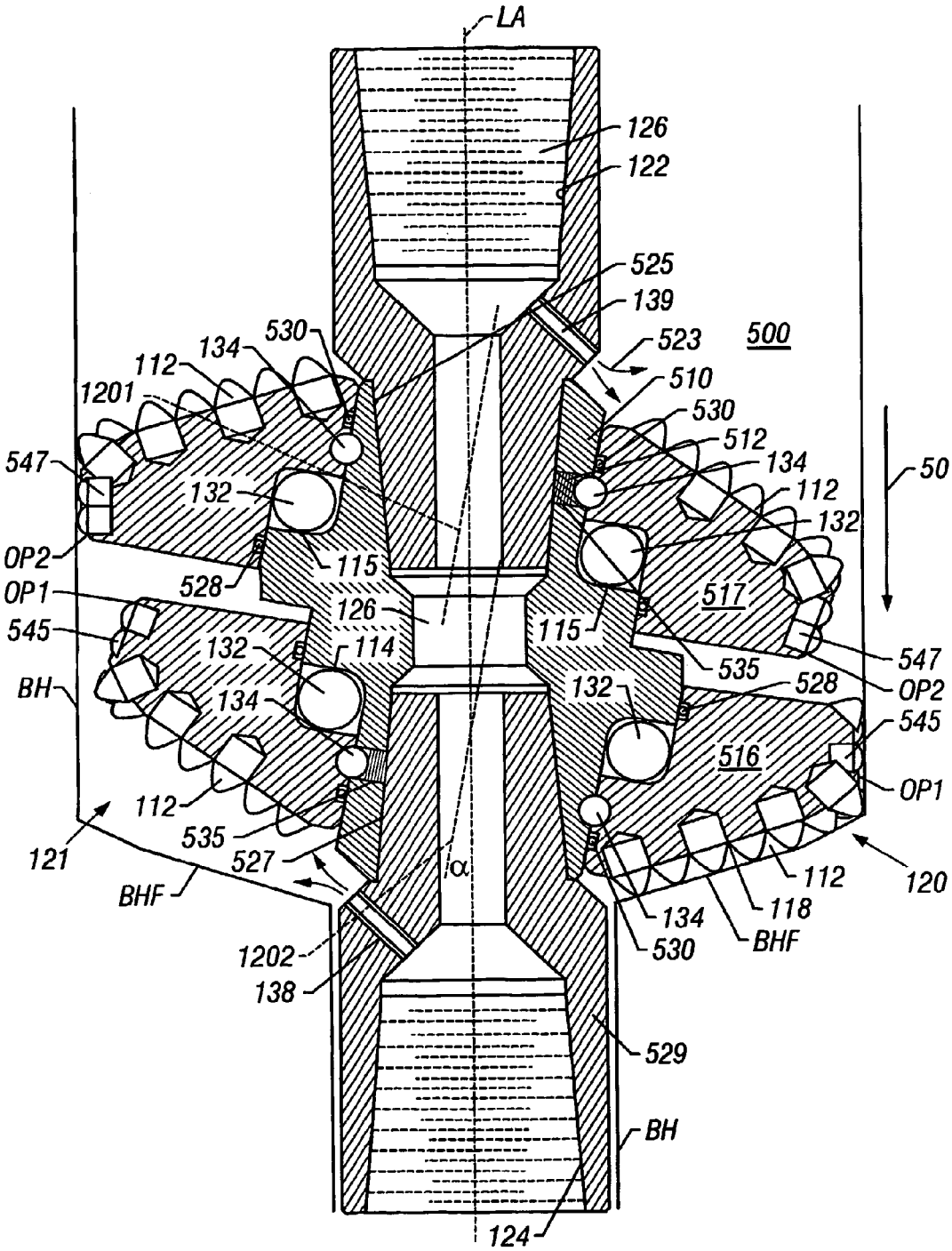
FIG. 7 is a cross sectional view of another embodiment of a reamer opener according to the present invention.

FIG. 7 is a cross-sectional view of one embodiment of a reamer 500 according to the present invention in a borehole BH abutting borehole hole face BHF. The direction of longitudinal travel 50 of the tool is accomplished by rotational and longitudinal force exerted on tubular members, for example, drill string 10, (not shown) attached to the box end connection of a coupling adapter 122 in a manner well known to those in the drilling industry. The operator attaches the reamer or hole enlarger 500 immediately adjacent a drill bit 28 (not shown in this view, but generally described in FIG. 11) or within the bottom hole assembly (BHA) adjacent drill collars (not shown) and can proceed to place substantially greater loading or additional longitudinal force on the drill string because of the larger bearing surfaces allowed by the design of the present invention. Alternatively, the hole enlarger can be connected immediately adjacent a bull plug or guide which connected to the end of the body and guides the hole enlarger through a previously drilled pilot hole (not shown, but well known to those in the industry). In utility drilling programs, such as long horizontal drilling under rivers or streets for the installation of utility lines, the hole enlarger can be either pushed into the hole or drawn back through a previously drilled pilot hole to the ingress side of the original drilling. The direction of travel 50 can be either into or out of a previously drilled pilot hole. Additionally, since the bearing surfaces of the present invention are substantially larger than the smaller bearings required on prior art multi-cone hole openers, an operator drills using the same longitudinal force for substantially longer periods of time without damage to the bearing surface.

Furthermore, the hole enlarger 500 operates symmetrically in either direction. If the cutting elements 112 on the cutter body 516 on one side of the hole opener 500 become excessively worn from abrasion with a hardened rock formation, the operator can reverse the connection of the hole opener 500 to put the opposite cutter body 517 with its unworn cutters 112 toward the bore hole face BHF and continue drilling. This feature permits a reamer to be used for an extended period of drilling without replacement of the cutter body.

In FIG. 7, coupling adapters or subs, 122 and 124, provide means for threaded engagement of each to a threaded tubular member such as a drill pipe on each (not shown), a drill pipe and a bull plug on the other (not shown), or a drill string and a drill bit (not shown in this view), all in a manner well known in this industry. Coupling adapter 122 provides a threaded pin 523 to engage a threaded box 525 on journal 510. Journal 510 provides on its opposing longitudinal end another threaded box end 527 for engagement with an adapter 124 having engaging threads 529.

Journal 510 provides two opposing thrust bearing race surfaces 114 and 115 supporting thrust bearings 132. In the present embodiment, journal 510 also provides a central passage 126 to permit fluid communication from coupling adapter 122 to coupling adapter 124. A central passage runs through the entirety of the reamer 500 to provide drilling fluid communication through the jets 138 or 139, depending on which cutter body 516 or 517 is performing the cutting, to the bore to cool and lubricate the hole opener 500 and to carry away the cuttings from the borehole face BHF.

Journal 510 supports two longitudinally spaced toroidal cutter bodies 516 and 517 that are asymmetric relative to their respective maximum diameter, that is, the top portion is different from the bottom portion. Each of the cutter bodies 516 and 517 rotate on an axis RA1 and RA2, respectively, skewed at an acute angle α from the longitudinal axis LA of the coupling adapters and the drill string (not shown) to which the reamer is to be attached. The outer perimeter OP1 and OP2 at the maximum diameter of the respective cutter bodies 516 and 517 encircles the longitudinal axis LA. In this embodiment, the axes RA1 and RA2 are each skewed 10° from the longitudinal axis LA. The skew angle is at an acute angle α that assures that the cutter teeth 112 on portion 120 of the cutter body 516 are fully engaged to crush the borehole face BHF while the diametrically and laterally spaced cutter teeth 112 on portion 121 stand entirely off the face of the borehole BHF. Further, the skew angle also keeps the lateral edge or outside perimeter OP1 of the cutter body 516 engaging the borehole face with centering cutter elements 545 which are opposed by the centering cutter elements 547 on the outside perimeter OP2 of the cutter body 517 contacting the borehole BH.

The second cutter body 517 carried on the journal 510 centers the tool 500 in the borehole BH by centering cutter elements 547. The skew angle on the second cutter body 517 provides clearance of the cutter teeth 112 thereon and centering cutting elements 547 located away from the borehole wall thereby eliminating the dragging associated with other types of hole enlargers.

Each cutter body 516 and 517 is provided with inner seals in seal groove 528 and outer seals in seal groove 530 to prevent fluid from entering the bearing races defined between the cutter bodies 516 and 517 and the journal 510. Cutter bodies 516 and 517 are each retained on the journal 510 by bearings 134 inserted in a sealed raceway formed between the inner surface of the cutter body and the outer surface of the journal through a hole 535 drilled in the journal body 510. Upon assembly of the reamer 500, the assembler will put the cutter body 516 or 517 over the journal 510 after seating the bearings 132, then insert the retainer bearings 134 into the hole 535, all in a manner well known to those in this industry. The assembler will complete the assembly by inserting ball retainer 562. The process will be repeated for both cutter bodies and the hole opener will then be ready for connection as previously described in a drilling operation.

Figure 8:
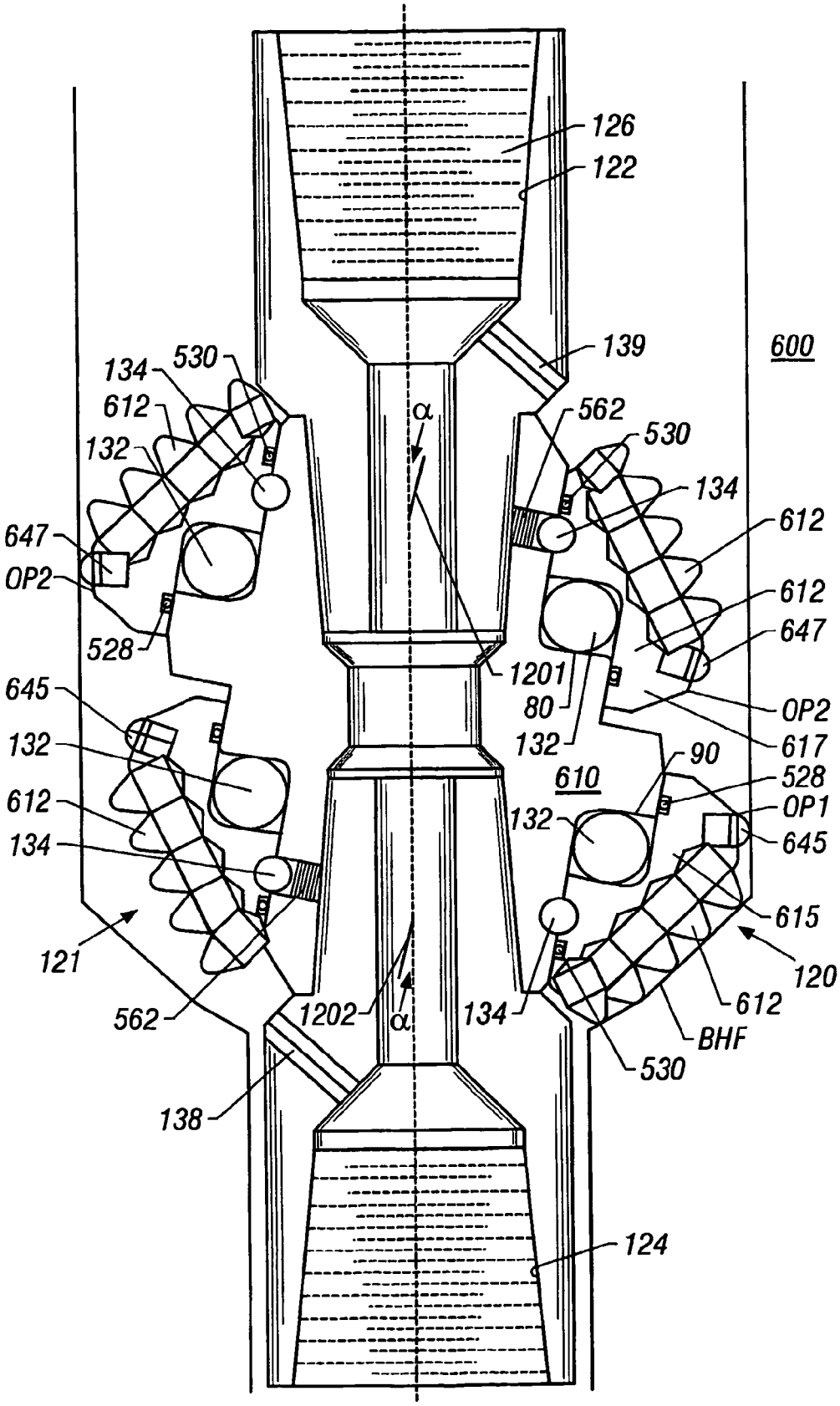
FIG. 8 is a cross sectional view of another embodiment of a reamer according to the present invention providing smaller cone bodies.

FIG. 8 is a cross sectional view of a smaller diameter hole opener 600. As may be readily appreciated from viewing this figure, the journal and connector adapters can be used for smaller diameter hole openers. Smaller cutter bodies on the same journal 610 can be substituted and used on the same coupling adapters 122 and 124. The smaller cutter bodies 616 and 617 are assembled in the same manner as described above for reamer 500 and the tool 600 can provide proportionately greater bearing surface to cutter surface thereby allowing a long service life for this smaller cutter body hole opener. The angle of the cutter body against the bore hole face has increased and the centering cutter elements on the lateral edge of each cutter body have been reduced, but the function is the same. The skew angle of the journal to the longitudinal axis of the drill journal body and the connected coupling adapters is the same as the angle of the larger diameter hole opener. In FIG. 8, this angle $\alpha$ is approximately 10°.

The embodiment in FIG. 8 contains coupling adapters 122 and 124, journal 610, cutter bodies 616 and 617 which are mounted on the journal 610 and rotate about their respective axis of rotation RA1 and RA2, each of which intersects the longitudinal axis LA of the drill string (not shown) that coincides with the longitudinal axis of the reamer. Thrust bearings 132 allow longitudinal loading of the cutters on the bore hole face BHF in a manner equivalent to the hole opener 500 described in FIG. 7. The cutter bodies 616 and 617 are retained on the journal 610 by retainer bearings 134 which are retained in the body by ball retainer 562. Coupling adapters provide jets 138 and 139 to clear cutting debris from the bore hole BH.

The action of the smaller diameter dual toroidal cutter body reamer 600 mirrors that of the larger diameter reamer 500. The cutter elements 612 on portion 120 engage on one side of the bore hole face BHF while the opposing cutter elements 612 on portion 121 are lifted off the face BHF by the skew angle $\alpha$ of the journal 610. The reamer or hole opener assembly is centered in the bore hole by the centering cutter elements 645 and 647 found on the lateral face or outer perimeter OP1 and OP2 of the toroidal cutter bodies 616 and 617, respectively, that are engaging the borehole BH. Since this reamer can operate in either direction, the worn cutters which can slow the rate of penetration of the reamer can be remedied by merely flipping the obverse reamer in the drill string so that the primary direction of travel is provided with the fresh cutter elements previously found on the reverse side of the reamer in the same manner as the larger reamer.

Figure 9:
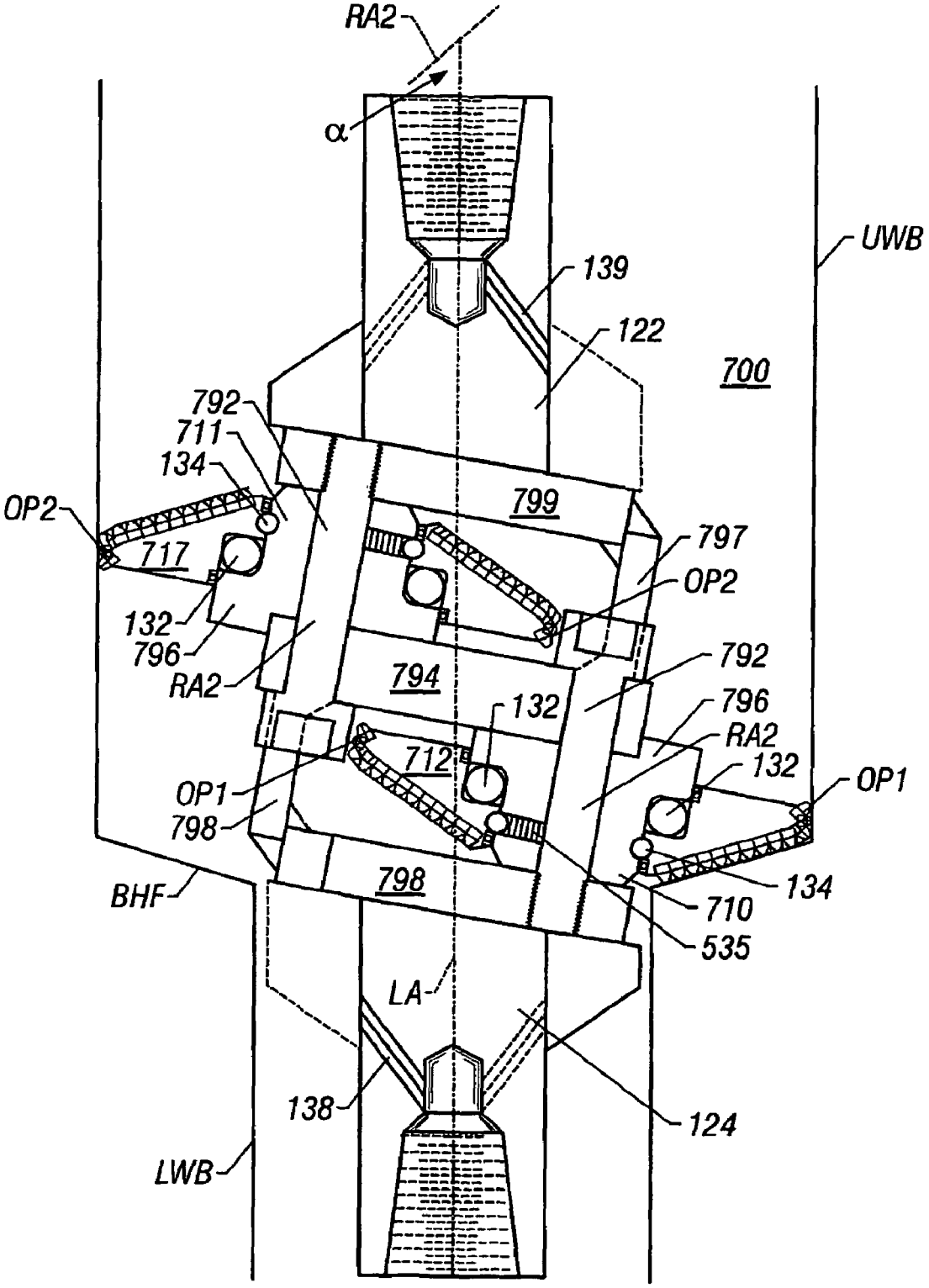
FIG. 9 is a cross sectional view of another embodiment of a reamer according to the present invention providing a large diameter hole opener.

FIG. 9 discloses an alternative embodiment of the dual toroidal cutter body reamer previously discussed. For illustrative purposes only, the existing hole size in the lower well bore LWB is 20 inches at the lower bore hole before opening and 36 inches after use of the hole opener in the upper well bore UWB. Reamer 700 varies from the smaller hole opener described above, but the operation of the hole opener 700 is equivalent. In this embodiment, each journal body 710 and 711 is bolted to the connector adapters or subs 124 and 122, respectively, by a large socket head cap screw 792 which serves to anchor an intermediate journal support plate 794, and the journals 710 and 711 to the opposing connector adapter 124 and 122, respectively, while providing rotational support for the cutter bodies 716 and 717. As may be also appreciated, each journal 710 and 711 overhangs the journal support plate 794 with shoulder 796 which provides a flat milled surface which prevents the journals 710 and 711 from turning as the reamer 700 is rotated in the borehole.

As may be readily appreciated after reviewing FIGS. 1 through 11, a reamer or hole opener can be fabricated in a number of differing sizes and configurations without departing from scope or intent of the invention disclosed herein. Similar to the smaller embodiments, each journal of the reamer supports a plurality of large thrust bearings which carry the longitudinal force and assure the relatively free rotation of the cutter bodies on each journal. Retainer bearings are provided for and mounted in a raceway formed between the outer surface of the journal and the inner surface of the cutter body in the same manner previously described herein for the smaller diameter hole openers.

Again referring to FIG. 9, on the side opposite the head cap screw pathway, each opposing connector adapter 124 and 122 is integrally connected to the journal support plate 794 by bosses or tabs 797 which flank the head cap screw pathways and offer structural support to the entire assembly. As may be appreciated from FIG. 9, upon installation of the head cap screws 792, through the journal support plate 794 and each journal 710 and 711, into the trussed plates 798 and 799 on the adapter 124 and 122, respectively, the large diameter reamer 700 can be used in either direction and can be flipped end over end and used going in either direction. The adapters or subs 124 and 122 also provide jetting ports 138 and 139, respectively, to direct drilling fluid toward the cutting surfaces.

Figure 10:
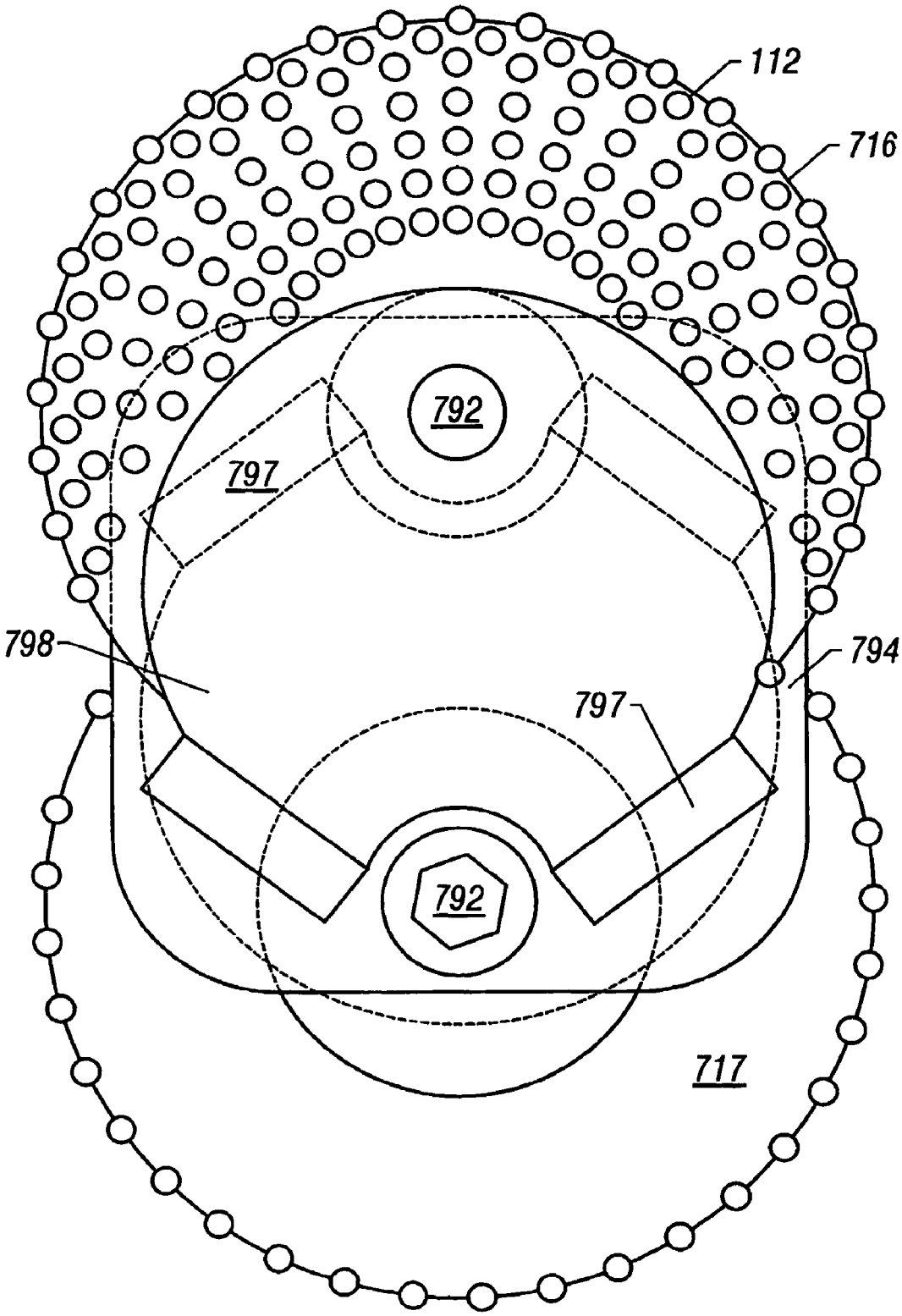
FIG. 10 is a schematic bottom end view of the toroidal cutter bodies of the large diameter hole opener of FIG. 9 deployed within a bore hole.

FIG. 10 shows the cross sectional end view of the large reamer. The opposing toroidal cutter bodies balance each other to form a round and symmetric hole throughout the operation of the opener. There is more than adequate room to evacuate the cuttings through the ample passageway formed on each side of the reamer with the interior bore of the opened hole. Cutter elements 112 are inserted in lower cutter body 716. Tabs or bosses 797 are affixed to the journal support plate 794 and straddle the pathways for insertion of the head cap screws 792. The socket head cap screw 792 is tightened through the pathway provided in the plate 798. The back side of the upper cutter body 717 can be viewed from below and its cutter elements act to centralize the hole opener 700 throughout its rolling engagement with the well bore BH.

Figure 11:
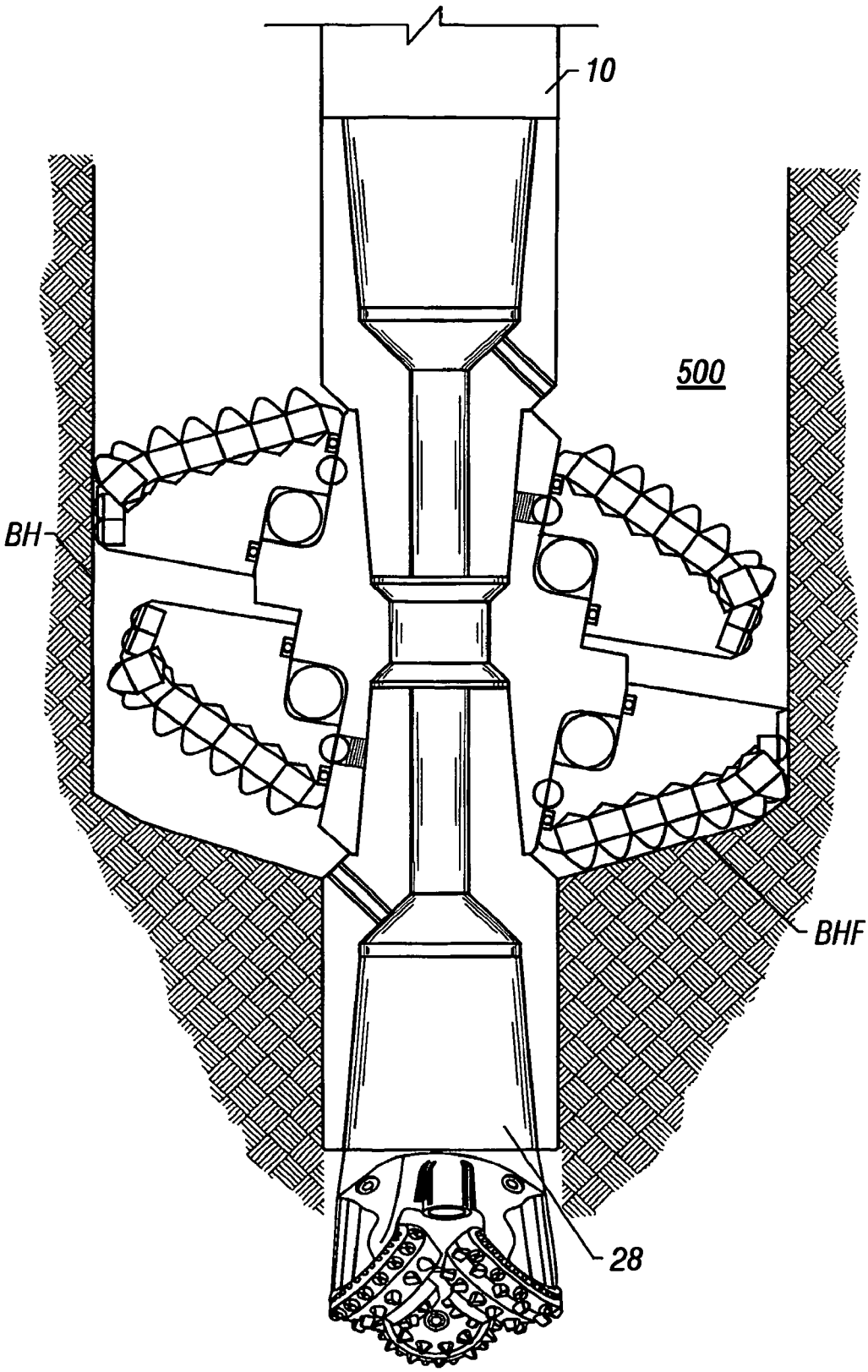
FIG. 11 is partially schematic view of an embodiment of a reamer according to the present invention connected to a drill pipe in a well bore from above and to a drill bit immediately below the hole opener.

FIG. 11 discloses a partially schematic view of an embodiment of a reamer according to the present invention, for example, reamer 500 shown in FIG. 7, though any of the other embodiments can be substituted therefor, connected to a drill string at the upper end and a drill bit at its lower end in a manner familiar to all those involved in this industry. Other operational configurations could be obtained using the present reamer without departing from the spirit or intent of the invention disclosed herein. As may be appreciated from the foregoing description and the attached drawings, the large bearing surfaces and the balanced opposed toroidal cutter bodies allow significant compression to be applied to the hole opener without damage or excessive wear. Drilling can proceed quickly and for longer periods of time without the need for replacement or fishing of broken hole opener arms from the borehole.

The large bearing surfaces and strength of the reamer embodiments according to the present invention permit larger loads to be placed on the body than has heretofore been available to drilling personnel. Since the reamer can be pulled back through a pilot hole, substantial progress can be made by increasing the pulling power of the drilling rig being used and does not, unlike conventional cutter movement, depend upon hydrostatic pressure from a pump system or the rotational speed of the drill string.

Since the reamer embodiments according to the present invention offer little resistance to the rotational movement of the drill string, cutting is accomplished by the crushing effect of the cutter buttons being either pushed or pulled against face of the well bore surface. The reamer offers no inherent torque into the drill string since it is free to rotate. Torque remains relatively constant throughout the reaming process. The crushing of the wall of the borehole can be readily accomplished by the longitudinal loading of the drill string.

Since only one or a few of the cutter buttons on the anterior face of the reamer (or those facing the direction of travel of the reamer in the borehole) will be in contact with the formation face at one point, the full longitudinal force will be focused on the few buttons in contact. The crushing effect of these few buttons having the full longitudinal force of the drill string will increase the rate of penetration and reaming that can be accomplished over traditional multi-coned cutter assemblies because the forces in those bodies are spread among several distinct points of contact required to maintain and centralize the cutter in the hole thereby permitting prior art cutters to rotate.

In operation, it is expected that a pilot hole will first be drilled in a manner well known to those skilled in the art. After the pilot hole is drilled, the drill string can be fitted with the reamer. If going into the hole, a guide shoe can be placed ahead of the reamer into the pilot hole to guide the reamer. In utility construction, since the point of egress of the pilot hole drill can be on the surface, the driller will install the reamer to be pulled back through the pilot hole. Very often, the utility construction drilling rigs lack the pump capacity of large oil and gas drilling rigs to drive downhole drilling mud motors. Consequently, utility construction rigs often can exert more force on the reamer of the present invention when pulling the reamer back through the pilot hole than was previously permitted with the smaller and more fragile cutter bodies. It is believed that the greater longitudinal force exerted against this toroidal reamer will increase the rate of hole opening in all formations and provide a longer service life for the tool. The saving in time of reaming and repair will substantially reduce overall drilling costs.

The cutter body in each of these embodiments has a cutting surface which has cutting elements thereon. The cutter body is free to rotate about is axis of rotation RA. The acute angle $\alpha$ between the axis of rotation RA and the longitudinal axis LA of the drill string is such that only a portion of the cutting surface of the cutter body, preferably not more than one-half of the cutting surface, is moved into engagement with the face of the well bore adjacent the pilot hole. As the drill string rotates, the reamer engages the well bore at the borehole face with a cutting or impact element on a portion of the rotatable cutter body, while holding the adjacent cutting or impact elements away from the bore face. In each of the specific embodiments disclosed herein, the acute angle $\alpha$ was about 10 degrees. However, other acute angle magnitudes can be used that satisfy the functional limitation given above. The acute angle $\alpha$ can, for example, range from about 5 to about 20 degrees, more preferably from about 8 to about 15 degrees.

Although the description above contains many specifics, these should not be construed as limiting the scope of the invention but as merely providing illustrations of some of the presently preferred embodiments of this invention.

What is claimed is:

1. A reamer for enlarging a bore hole in conjunction with a drill string, the reamer comprising:

at least one journal body comprising a tubular body having one journal portion and one toroidal crusher body rotatably attached thereto;

means for attaching the at least one journal body to the drill string;

the toroidal crusher body, having a maximum diameter, an outer perimeter at the maximum diameter, a crushing surface, and a plurality of crushing buttons on the crushing surface;

wherein the toroidal crusher body is rotatably attached to the at least one journal body;

wherein the journal portion comprises an enlarged cylindrical surface removably, but irrotatably, mounted on a central portion of an exterior of the tubular body, the enlarged cylindrical surface having a central axis intersecting a longitudinal axis of the tubular body at an acute angle, and the toroidal crusher body having an inner surface rotatably engaging the enlarged cylindrical surface of the tubular body; and when in an installed position, the axis of rotation of the toroidal crusher body intersects the longitudinal axis of the drill string at an acute angle and the outer perimeter encircles the longitudinal axis.

2. A reamer for enlarging a bore hole in conjunction with a drill string, the reamer comprising:

at least one journal body;

means for attaching the at least one journal body to the drill string;

at least one toroidal crusher body, each having a maximum diameter, an outer perimeter at the maximum diameter, a crushing surface, and a plurality of crushing buttons on the crushing surface, wherein the at least one toroidal crusher body is rotatably attached to the at least one journal body and is asymmetrical relative to a plane in the maximum diameter thereof; and when in an installed position, an axis of rotation of each of the at least one toroidal crasher body intersecting a longitudinal axis of the drill string at an acute angle and the outer perimeter encircling the longitudinal axis.

3. A reamer for enlarging a bore hole in conjunction with a drill string, the reamer comprising:

at least one tubular body having two journal portions;

means for attaching the at least one tubular body to the drill string;

a toroidal crusher body attached to each journal portion, each toroidal crusher body having a maximum diameter, an outer perimeter at the maximum diameter, a crushing surface, and a plurality of crushing buttons on the crushing surface, whereto, the at least one toroidal crusher body is rotatably attached to the at least one journal body;

when in an installed position, an axis of rotation of the toroidal crusher body intersecting a longitudinal axis of the drill string at an acute angle and the outer perimeter encircling the longitudinal axis;

wherein each of the two journal portions is positioned on the at least one tubular body such that the axes of rotation of the two toroidal crusher bodies are longitudinally spaced from each other and their respective crushing surfaces face away from each other; and wherein each of the two toroidal crusher bodies is asymmetrical relative to a plane in its respective maximum diameter.

4. A reamer for enlarging a bore hole in conjunction with a drill string, the reamer comprising:

a first journal body and a second journal body;

at least a first connector adapter, a second connector adapter and an intermediate journal support plate to attach the first journal body and the second journal body to the drill string;

a first toroidal crusher body and a second toroidal crusher body, each toroidal crusher body having a maximum diameter, an outer perimeter at the maximum diameter, a crushing surface, and a plurality of crushing buttons on the crushing surface;

wherein the first toroidal crusher body is rotatably attached to the first journal body and the second toroidal crusher body is rotatably attached to the second journal body;

wherein the first journal body at one end is attached to the first connector adapter and at its other end to the intermediate support plate, and the second journal body at one end is attached to the second connector adapter and at its other end to the intermediate support plate; and when in an installed position, axes of rotation of the first and second toroidal crusher bodies intersecting a longitudinal axis of the drill string at an acute angle and the outer perimeters thereof encircling the longitudinal axis.

5. The reamer of claim 4, wherein, when in an installed position, the acute angle for the first and second toroidal crusher bodies is the same.

6. The reamer of claim 4, wherein, when in an installed position, the axes of rotation of the first and second toroidal crusher bodies intersect the longitudinal axis of the drill string at different points longitudinally spaced from each other.

7. A reamer for enlarging a bore hole in conjunction with a drill string, the reamer comprising:

at least one journal body;

means for attaching the at least one journal body to the drill string;

at least one toroidal crusher body, each toroidal crusher body having a maximum diameter, an outer perimeter at the maximum diameter, a crushing surface, and a plurality of mill teeth in a zig-zag pattern on the crushing surface, wherein the at least one toroidal crusher body is rotatably attached to the at least one journal body; and when in an installed position, an axis of rotation of each of the at least one toroidal crusher body intersecting a longitudinal axis of the drill string at an acute angle and the outer perimeter encircling the longitudinal axis.

* * * * *